US011421836B2

(12) United States Patent
Zeitler et al.

(10) Patent No.: US 11,421,836 B2
(45) Date of Patent: Aug. 23, 2022

(54) POLE MOUNTED TORCH ASSEMBLY

(71) Applicant: Lamplight Farms Incorporated, Menomonee Falls, WI (US)

(72) Inventors: Lucas Henry Zeitler, Wauwatosa, WI (US); Robert Woodruff, Oconomowoc, WI (US); David A. Reed, Hartford, WI (US)

(73) Assignee: Lamplight Farms Incorporated, Menomonee Falls, WI (US)

( * ) Notice: Subject to any disclaimer, the term of this patent is extended or adjusted under 35 U.S.C. 154(b) by 0 days.

(21) Appl. No.: 17/131,144

(22) Filed: Dec. 22, 2020

(65) Prior Publication Data

US 2022/0196217 A1 Jun. 23, 2022

(51) Int. Cl.

| | |
|---|---|
| ***F21S 8/08*** | (2006.01) |
| ***F21V 37/00*** | (2006.01) |
| ***F21V 17/00*** | (2006.01) |
| ***F21V 17/16*** | (2006.01) |
| ***F23D 3/02*** | (2006.01) |

(52) U.S. Cl.

CPC ..... *F21S 8/08* (2013.01); *F21V 17/002* (2013.01); *F21V 17/162* (2013.01); *F21V 37/002* (2013.01); *F21V 37/0008* (2013.01)

(58) Field of Classification Search

CPC ..... A01M 29/12; A01M 29/14; F21S 15/00; F21S 6/001; F21S 8/08–083; F21L 17/00; F21L 17/002; F21L 17/162; F21V 21/13; F21V 21/10; F21V 35/00–006; F21V 37/00; F21V 37/0004–0037

See application file for complete search history.

(56) References Cited

U.S. PATENT DOCUMENTS

| | | | | |
|---|---|---|---|---|
| 2003/0150965 | A1* | 8/2003 | Kitamura | F21V 35/00 248/146 |
| 2011/0097676 | A1* | 4/2011 | Masterson | F21V 37/0004 431/320 |
| 2013/0288189 | A1* | 10/2013 | White | F21V 37/0004 431/310 |
| 2020/0096199 | A1 | 3/2020 | Harrington et al. | |

* cited by examiner

*Primary Examiner* — Mariceli Santiago

(74) *Attorney, Agent, or Firm* — Gable Gotwals; David G. Woodral

(57) ABSTRACT

A torch and support pole combination has a wick extending upwardly therefrom. A pole adapter with a pole receiver is affixed to a torch assembly. A support pole is received in the pole receiver. The pole has an outwardly biased spring tab that is compressible by an inside surface of the pole receiver until the spring tab is inserted to a location above a top surface of the pole receiver, thereby creating a secure attachment of the torch assembly to the pole. The upper end of the pole is inserted into the pole receiver. The outwardly biased spring tab on the pole is compressed with an inside surface of the pole receiver. Compression of the spring tab is relieved when the spring tab is inserted to a location above a top surface of the pole receiver, thereby creating a secure attachment of the torch assembly to the pole.

5 Claims, 6 Drawing Sheets

POLE MOUNTED TORCH ASSEMBLY

FIELD OF THE INVENTION

The invention relates to a torch assembly. More particularly, the invention relates to an improved mechanism for affixing a torch assembly to a support pole.

BACKGROUND OF THE INVENTION

Patio torches, also known as lawn torches or garden torches, may be used to provide lighting or decoration. Sometimes, scented oils or insect repellent oils are burned in the patio torches for additional effect. A torch may include a refillable canister that accepts liquid fuel.

Typically, patio torches are mounted on a pole. It is desirable to provide an inexpensive and reliable design for securing a patio torch to an upper end of a mounting pole.

SUMMARY OF THE INVENTION

A torch assembly and support pole combination is described herein. The torch assembly includes a can assembly. The can assembly has a can body having top surface and a bottom surface. A can body top is received the top surface and a can body bottom is received on the bottom surface.

A flame guard is received on the can body top of the can body. The flame guard defines a wick orifice. The flame guard is preferably threadably received on the can body top.

A wick is received in the wick orifice of the flame guard. The wick has an upper end that extends above the flame guard and a lower end in contact with the can body bottom of the can assembly. A snuffer is removably received on the flame guard.

A sleeve surrounds the can assembly. A torch head surrounds the sleeve. The torch head has a bottom end that extends below the bottom surface of the can body.

A pole adapter tray is affixed to the bottom end of the torch head. The pole adapter tray has a tray portion that defines an upper surface and that defines a drain hole and a central hole. The pole adapter tray has a frusto-conical protrusion portion that extends above the upper surface of the tray portion. The frusto-conical protrusion portion defines an inside surface and a top surface. In one embodiment, the frusto-conical protrusion portion defines an internal taper having a 5 degree slope.

A support pole has an upper end that defines a taper. The support pole further defines a spring tab orifice adjacent the upper end. A spring tab protruding from the spring tab orifice. The spring tab is biased in an extended position, but may be pushed inwardly while the support pole is inserted into the frusto-conical protrusion portion of the pole adapter tray. Once the pole is fully inserted, i.e., when the spring tab emerges above the top surface of the frusto-conical protrusion, the spring tab creates a secure attachment of the torch assembly to the support pole.

More particularly, the torch and support pole combination of the invention includes a torch assembly having a wick extending upwardly therefrom. In one embodiment, the torch assembly includes a can assembly having a bottom surface, a sleeve surrounding the can assembly and a torch head surrounding the sleeve. A pole adapter is affixed to the torch assembly. The pole adapter has a pole receiver that has an inside surface and a top surface. In one embodiment, the pole adapter defines a pole adapter tray that is affixed adjacent to a bottom end of the torch head and the pole receiver of the pole adapter protrudes above the pole adapter tray. In one embodiment, the pole receiver is a frusto-conical protrusion portion having a taper with a slope of between and 3 and 7 degrees. A support pole having an upper end is received in the pole receiver. In one embodiment, the support pole has an outwardly biased spring tab that is compressible by the inside surface of the pole receiver until the spring tab is inserted to a location above the top surface of the pole receiver, thereby creating a secure attachment of the torch assembly to the support pole. In one embodiment, the support pole defines a spring tab orifice, and the spring tab is an outwardly biased member that extends from the spring tab orifice. In another embodiment, the spring tab may be located on the pole receiver wherein the spring tab is biased inwardly for being received in an interlocking arrangement with an orifice or groove defined by the support pole.

In use, an upper end of the support pole is inserted into a pole receiver of a pole adapter that is affixed to the torch assembly. The outwardly biased spring tab on the support pole is compressed with an inside surface of the pole receiver. Alternatively, an inwardly biased spring tab on the pole receiver may be compressed by insertion of the support pole.

Compression of the spring tab is relieved when the spring tab is inserted to a location above a top surface of the pole receiver, thereby creating a secure attachment of the torch assembly to the support pole.

DETAILED DESCRIPTION OF THE PREFERRED EMBODIMENTS

Figure 4:
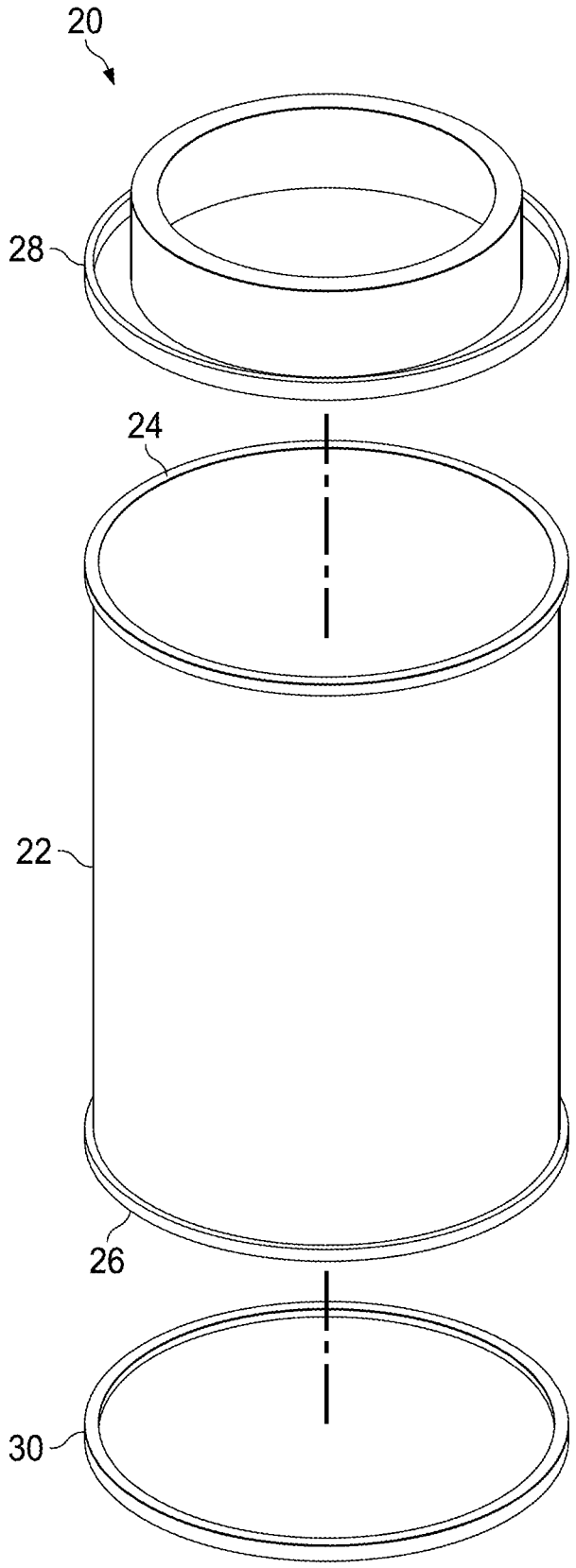
FIG. 4 is an exploded view of a can assembly of the torch assembly of FIG. 1.
Figure 5:
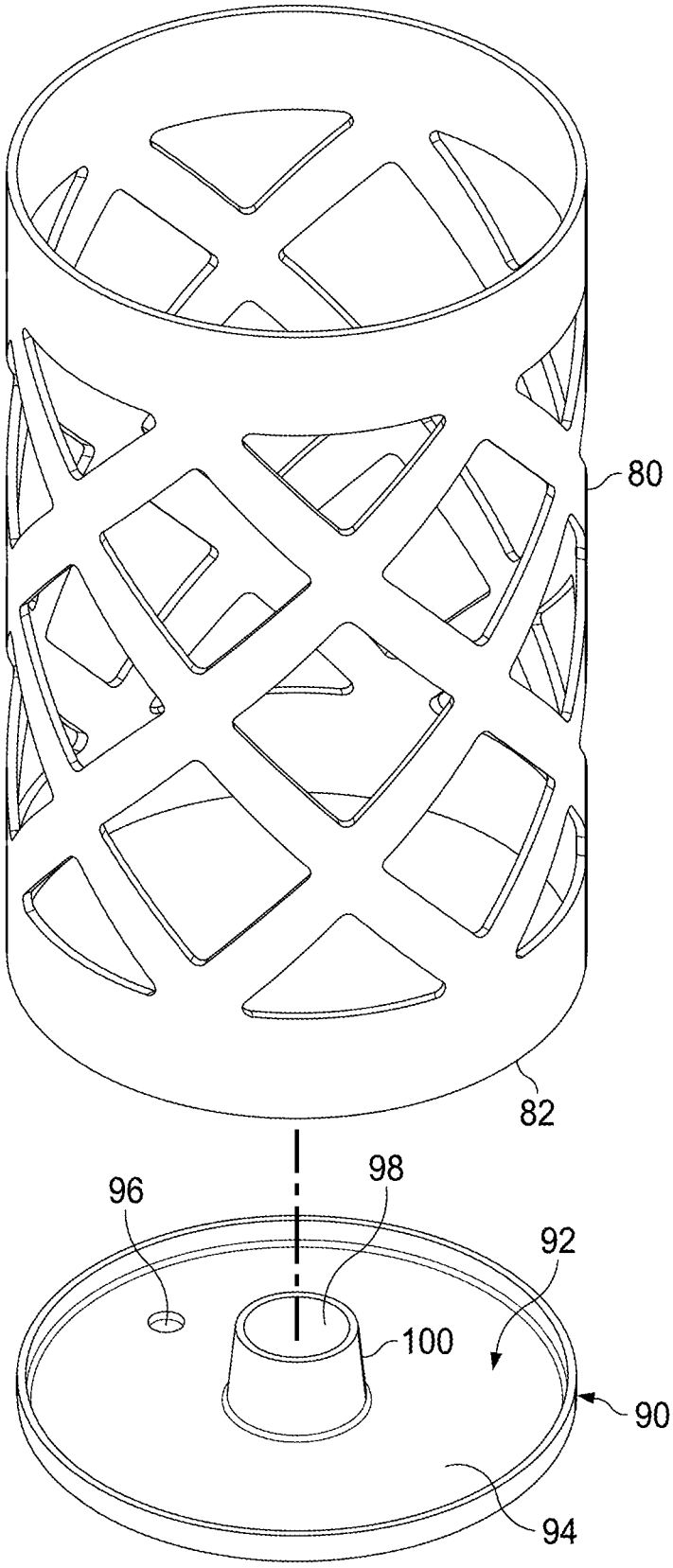
FIG. 5 is a perspective view of a torch head and pole adapter tray of the torch assembly of FIG. 1.
Figure 6:
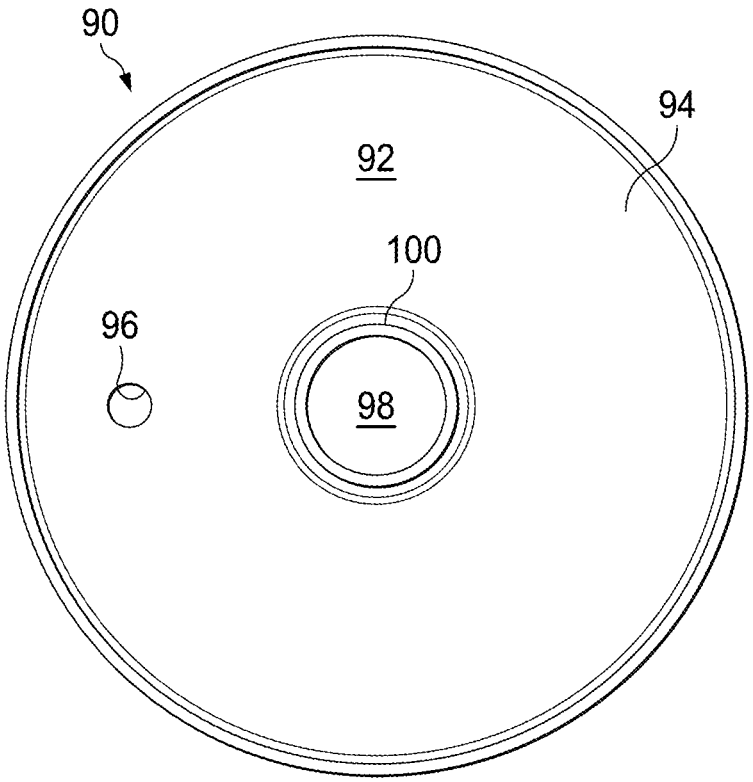
FIG. 6 is a plan view of the pole adapter tray of the torch assembly of FIG. 1.
Figure 7:
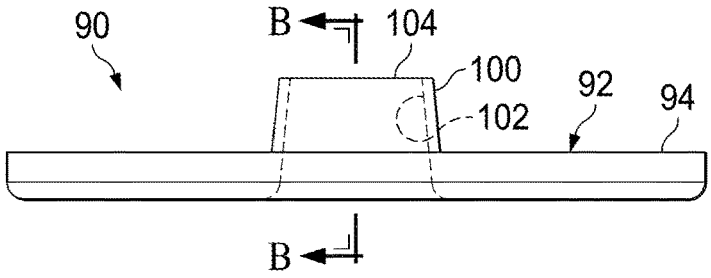
FIG. 7 is an elevation view of the pole adapter tray of the torch assembly of FIG. 1.

Referring now to the figures, shown is a torch assembly 10 of the invention. Torch assembly 10 includes can assembly 20. Can assembly 20 includes a can body 22 having a top surface 24 and a bottom surface 26 (see, e.g., FIG. 4). Can body top 28 is received on top surface 24. Can body bottom 30 is received on bottom surface 26 of can assembly 20.

Flame guard 40 is preferably threadably received on can body top 28 of can body 22. Flame guard 40 defines wick orifice 42.

Wick 50 is received in wick orifice 42 of flame guard 40. Wick 50 has an upper end 52 extending above flame guard 40 and a lower end 54 that preferably makes contact with can body bottom 30 of can assembly 20.

Snuffer 60 is preferably removably received on flame guard 40.

Figure 2:
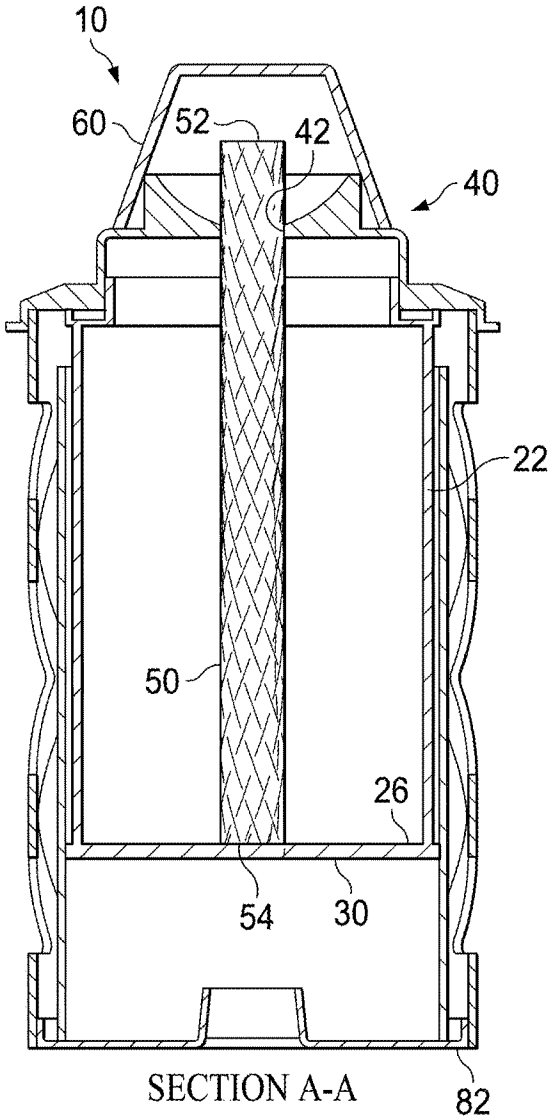
FIG. 2 is a cross sectional elevation view of the torch assembly of FIG. 1 taken along line A-A of FIG. 1.
Figure 1:
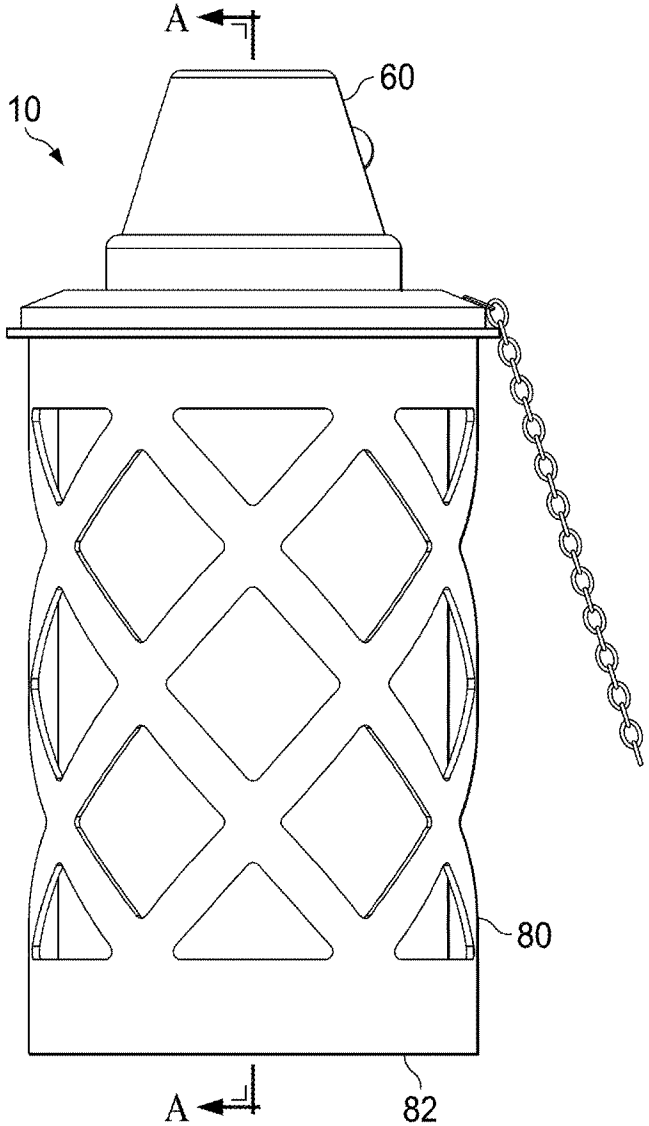
FIG. 1 is an elevation view of a torch assembly of the invention.
Figure 3:
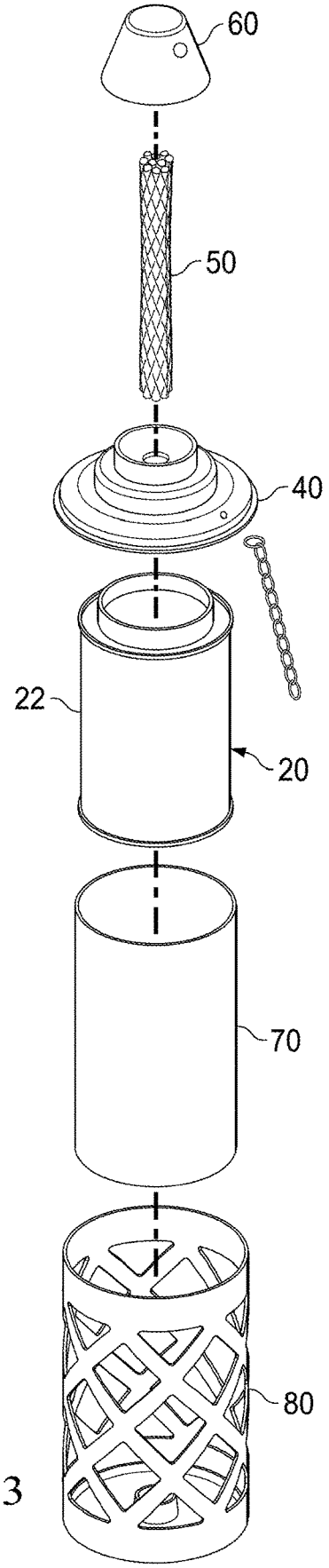
FIG. 3 is an exploded perspective view of the torch assembly of FIG. 1.

Sleeve 70 surrounds can assembly 20. Torch head 80 surrounds sleeve 70. Torch head 80 has bottom end 82 that extends below bottom surface 26 of can body 22 (see, e.g., FIG. 2).

Figure 8:
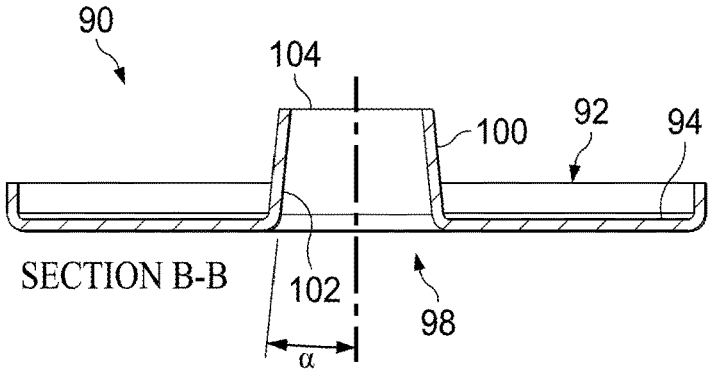
FIG. 8 is a cross sectional elevation view of the pole adapter tray of the torch assembly of FIG. 1.

Pole adapter tray 90 (best seen in FIGS. 5-8) is affixed to bottom end 82 of torch head 80. Pole adapter tray 90 has a tray portion 92. Tray portion 92 defines upper surface 94, drain hole 96, and central hole 98. Pole adapter tray 90 additionally has frusto-conical protrusion portion 100 that extends above upper surface 94 of tray portion 92. Protrusion portion 100 defines inside surface 102 and top surface 104. Protrusion portion 100 preferably has a taper. The taper of protrusion portion 100 may define a slope having an angle $\alpha$ (see, FIG. 8) of 1-10 degrees, more preferably 3 to 7 degrees, most preferably 5 degrees.

Figure 9:
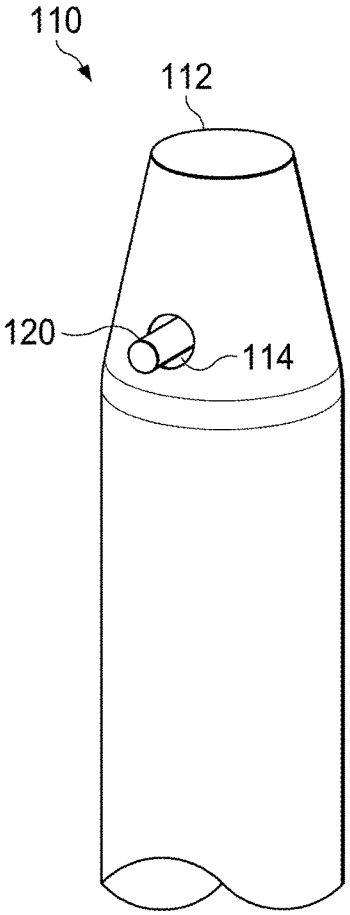
FIG. 9 is a perspective view of a support pole for supporting the torch assembly of FIG. 1.

Referring now to FIG. 9, support pole 110 has upper end 112. Upper end 112 preferably defines a taper. Support pole 110 defines spring tab orifice 114 adjacent upper end 112. A spring tab 120 protrudes from spring tab orifice 114.

In use, upper end 112 of support pole 110 may be received in protrusion portion 100 such that spring tab 120 is compressed by inside surface 102 of protrusion portion 100 until spring tab 120 is inserted to a location above top surface 104 of protrusion portion 100, whereupon spring tab 120 extends, thereby creating a secure attachment of torch assembly 10 to support pole 110.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A torch and support pole combination comprising:

a torch assembly;

a wick extending above said torch assembly;

a pole adapter affixed to said torch assembly, said pole adapter having a pole receiver having an inside surface and a top surface;

a support pole having an upper end for being received in said pole receiver;

a spring tab that is compressible during insertion of said support pole into said pole receiver, said spring tab extending when said pole is fully inserted, thereby creating a secure attachment of said torch assembly to said support pole;

wherein said torch assembly comprises a can assembly having a bottom surface, a sleeve surrounding said can assembly and a torch head surrounding said sleeve.

2. The torch assembly according to claim 1 wherein:
said pole receiver comprises a frusto-conical portion.

3. The torch assembly according to claim 2 wherein:
said frusto-conical portion has a taper having a slope of between and 3 and 7 degrees.

4. The torch assembly according to claim 1 wherein:
said support pole defines a spring tab orifice; and
said spring tab is an outwardly biased member that extends from said spring tab orifice.

5. The torch assembly according to claim 1 wherein:
said spring tab is carried by said support pole, said spring tab compressible by said inside surface of said pole receiver until said spring tab is inserted to a location above said top surface of said pole receiver.

* * * * *